US006416389B1

(12) United States Patent
Perry et al.

(10) Patent No.: US 6,416,389 B1
(45) Date of Patent: Jul. 9, 2002

(54) PROCESS FOR ROUGHENING A SURFACE

(75) Inventors: Philip G. Perry, Webster; Rajiv S. Agarwala, Fairport; Jodie L. Morris; Loren E. Hendrix, both of Webster; Carmen W. Enos, Fairport; Gregory J. Arserio, Macedon, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/627,880

(22) Filed: Jul. 28, 2000

(51) Int. Cl.[7] ..... B24B 1/00; B24C 1/00

(52) U.S. Cl. ..... 451/36; 451/38; 451/39; 451/40

(58) Field of Search ..... 451/28, 36, 37, 451/38, 39, 40

(56) References Cited

U.S. PATENT DOCUMENTS

| | | | | |
|---|---|---|---|---|
| 4,191,201 A | | 3/1980 | Barnsbee | 134/104 |
| 4,426,311 A | | 1/1984 | Vander Mey | 252/143 |
| 5,062,898 A | | 11/1991 | McDermott et al. | 134/7 |
| 5,108,512 A | | 4/1992 | Goffnett et al. | 134/7 |
| 5,209,028 A | | 5/1993 | McDermott et al. | 51/426 |
| 5,294,261 A | | 3/1994 | McDermott et al. | 134/7 |
| 5,372,652 A | | 12/1994 | Srikrishnan et al. | 134/7 |
| 5,390,450 A | | 2/1995 | Goenka | 451/75 |
| 5,431,740 A | | 7/1995 | Swain | 134/7 |
| 5,514,024 A | | 5/1996 | Goenka | 451/39 |
| 5,616,067 A | | 4/1997 | Goenka | 451/39 |
| 5,679,062 A | | 10/1997 | Goenka | 451/75 |
| 5,766,368 A | | 6/1998 | Bowers | 134/6 |
| 5,782,263 A | | 7/1998 | Isaacson, Jr. et al. | 137/487.5 |
| 5,836,809 A | | 11/1998 | Kosic | 451/89 |
| 5,853,128 A | | 12/1998 | Bowen et al. | 239/329 |
| 5,916,720 A | * | 6/1999 | Springett | 430/63 |
| 5,919,594 A | | 7/1999 | Perry et al. | 430/127 |
| 5,976,264 A | | 11/1999 | McCullough et al. | 134/2 |

* cited by examiner

*Primary Examiner*—M. Rachuba
(74) *Attorney, Agent, or Firm*—Robert Thompson

(57) ABSTRACT

A process including providing a member having an exposed outer metal surface and propelling irregularly shaped solid carbon dioxide granules against the exposed outer metal surface with sufficient force to alter the texture of the outer metal surface to a predetermined surface roughness.

14 Claims, No Drawings

PROCESS FOR ROUGHENING A SURFACE

BACKGROUND OF THE INVENTION

This invention relates in general to a process for treating surfaces and, more specifically, to a process for roughening the outer surface of a member.

Electrostatographic imaging members, such as photoreceptors, are conventionally utilized for copiers and printers and comprise a hollow electrically conductive drum substrate which has been dip coated with various coatings including at least one photoconductive coating comprising pigment particles dispersed in a film-forming binder. The photoconductive coating usually includes a charge generating layer and a charge transport layer. A problem experienced during the formation of electrostatic images on these electrostatographic imaging members using laser beam exposure techniques involves the undesirable formation of a plywood-like pattern in the electrostatic latent image (known as the "plywood effect" or the "interference fringe effect") due to reflection of the laser beam that penetrated the charge generating layer of the imaging member to strike a normally smooth outer surface of a supporting substrate. This plywood-like pattern in the electrostatic latent image is converted to a visible toner image during development of the latent image. One of the reasons for this undesirable phenomenon is the reflective nature of the metal substrate used for the imaging member. To prevent this plywood effect, an expensive machining technique has been utilized to roughen the surface of the substrate to prevent reflection of the laser beam. Alternatively, or in addition to expensive machining, the outer surface of the substrate is roughened by techniques such as spraying an alumina (aluminum oxide) media/water slurry sprayed against the aluminum substrate surface. The alumina treated substrate surface is duller with microroughness, which reduces brightness and allows automatic visual inspection (AVI) systems to be used. Additionally, auto-density control lasers, which detect the degree of brightness in order to set up machine parameters for density control of the final image, may be used. If a machine is not within precise brightness ranges, the auto-density control cannot set up the machine. Unfortunately, even after cleaning of the roughened substrate surface, aluminum oxide media in the form of particles often adhere to the substrate surface to cause defects in imaging layer coatings subsequently formed on the substrate. These defects form unacceptable toner images. In addition, because of the abrasive nature of aluminum oxide media, the equipment used to apply the media to the substrate surface erodes rapidly resulting in equipment down time and expensive repairs. Generally, these aluminum oxide media comprise spherical beads. The alumina media is both costly and prone to stick to the substrate surfaces contributing to or resulting in unacceptable post coat defects. Thus, new imaging members having coatings containing aluminum oxide media are rejected and scrapped.

INFORMATION DISCLOSURE STATEMENT

U.S. Pat. No. 5,853,128 issued to Bowen et al. on Dec. 29, 1998—Method and apparatus are disclosed for controlling the exit velocity of solid/gas carbon dioxide spray cleaning systems. By increasing the pressure of liquid carbon dioxide in the supply line, typically in the range of 800–875 psi, to greater than 875 psi, preferably 2,000–5,000 psi and above, the velocity of the spray stream exiting the nozzle is increased enabling removal of contamination (oils, fingerprints, particles, graffiti, etc.) not removable with a spray stream using conventional carbon dioxide pressures. The apparatus includes the incorporation of a high-pressure pump in the liquid carbon dioxide supply line in combination with a nozzle having a first or inlet orifice smaller in diameter than the supply line and a second or exit orifice larger in diameter than the inlet orifice.

U.S. Pat. No. 5,782,263 issued to Isaacson, Jr. et al. on Jul. 21, 1998—A flood control device 200 is disclosed which measures the volume of fluid delivered in a continuous steady flow to a house or building and which shuts off the fluid flow if a preset maximum limit is reached, indicating overly high consumption due to a leak, break or open faucet in the plumbing of the house or building.

U.S. Pat. No. 5,766,368 issued to Bowers on Jun. 16, 1998—A method is disclosed of cleaning an integrated circuit chip module prior to attaching wire bonds thereto. The method involves disposing a module containing an integrated circuit chip and IC bond pads without wire bonds in an environmental process enclosure. A carbon dioxide jet spray cleaning system having a spray nozzle and orifice assembly is disposed the environmental process enclosure. A jet spray of carbon dioxide is generated using the jet spray cleaning system. The carbon dioxide jet spray is directed onto the surface of the module such that the spray impacts the IC bond pads and module bond pads to clean unwanted adhesive from the surface of the module and thus clean the IC and module bond pads.

U.S. Pat. No. 5,514,024 issued to Goenka on May 7, 1996—A $CO_2$ nozzle is disclosed which expels liquid $CO_2$ under pressure through an orifice therein for converting the liquid into $CO_2$ snow. The $CO_2$ nozzle is contained within an elongated mixing cavity within a body which is coupled to an exhaust nozzle for directing the $CO_2$ snow toward the workpiece. The $CO_2$ nozzle includes several wings for creating aerodynamic turbulence within the elongated mixing cavity for enhancing the coagulation of the $CO_2$ snow into larger $CO_2$ snow particles or $CO_2$ snowflakes.

U.S. Pat. No. 5,431,740 issued to Swain on Jul. 11, 1995—An apparatus is disclosed for cleaning cylindrical surfaces includes a plurality of cleaning stations. Each cleaning station is designed to receive a substrate and includes a plurality of nozzles. The inlet end of each nozzle is connected to a source of liquid Carbon Dioxide, and the outlet end of each nozzle is connected to one end of a respective Carbon Dioxide expansion chamber. Liquid Carbon dioxide leaving each nozzle is converted to solid Carbon Dioxide in the corresponding expansion chamber. The other end of each Carbon Dioxide expansion chamber is coupled to a respective funnel which is, in turn, connected to a dispersing saddle. The dispersing saddles disperse the stream of solid Carbon Dioxide particles leaving each funnel and direct these particles to the substrate surface. The dispersing saddles are placed such that the entire circumference of the substrate surface is enveloped within the various streams of solid Carbon Dioxide particles. In addition, the apparatus may include a source of a dry nonreactive gas which is introduced into each stream of solid Carbon Dioxide particles in order to reduce condensation on the surface from the surface of the substrate and to further direct each stream of solid Carbon Dioxide particles to the substrate surface.

U.S. Pat. No. 5,372,652 issued to Srikrishnan et al. on Dec. 13, 1994—An aerosol cleaning apparatus is disclosed for cleaning a substrate includes an aerosol producing means having a nozzle head. The nozzle head is positioned at a selected proximity and orientation to the substrate which is held by a rotatable holder. The aerosol spray dislodges particles from the substrate and the rotation of the substrate further assists in the removal of the loosened particles. A method of aerosol cleaning includes rotating a substrate at a preselected speed and spraying an aerosol jet in conjunction with the rotation to help in the removal of particles from the substrate.

U.S. Pat. No. 5,294,261 issued to McDermott et al. on Mar. 15, 1994—A method is disclosed for cleaning microelectronic surfaces using an aerosol of at least substantially solid argon or nitrogen particles which impinge upon the surface to be cleaned and then evaporate and the resulting gas is removed by venting along with the contaminants dislodged by the cleaning method.

U.S. Pat. No. 5,209,028 to McDermott et al, issued May 11, 1993—An apparatus is disclosed for cleaning semiconductor solid surfaces using a spray of frozen cryogen, such as argon, to impinge on the solid surface to remove contaminant particles. The apparatus includes an appropriate nozzle positioned in a housing designed for ultra clean conditions including sweep gas supply and evacuation conduits and a support table movably positioned within the housing to controllably convey the semi-conductor solid surface on a track under the spray of frozen cryogen emanating from the nozzle.

U.S. Pat. No. 5,062,898 issued to McDermott et al. on Nov. 5, 1991—A method is disclosed for cleaning microelectronics surfaces using an aerosol of at least substantially solid argon particles which impinge upon the surface to be cleaned and then evaporate and the resulting gas is removed by venting along with the contaminants dislodged by the cleaning method.

U.S. Pat. No. 4,426,311 issued to Vander Mey on Jan. 17, 1984—Methylene chloride-methane sulfonic acid compositions used in removing polymeric organic substances from inorganic substrates, such as polymeric adhesives from metal and lense glass parts and positive and negative photoresists from metallized silicon/silicon dioxide wafers, which comprise an effective amount, usually about 1 to 40 percent by weight methane sulfonic acid and the balance methylene chloride are described. Methods for using the above composition at ambient temperatures to remove the polymeric organic substances from the metal and nonmetallic inorganic substrates are also described.

U.S. Pat. No. 4,4,191,201 issued to Barnsbee on Mar. 4, 1980—Plastic film cartridges generally comprise a variety of component parts plus a label affixed by adhesive to the cartridge housing. The cartridge housing (a plastic) is recyclable when the label and adhesive are removed and the housing is separated from the other non-compatible plastic and non-plastic cartridge components. In accordance with the invention, multi-stage reclaiming apparatus is disclosed wherein film cartridges are first rough chopped to provide physical separation of the cartridge components. The cartridge housing pieces are separated from other cartridge components on the basis of differences in specific gravity in a series of specific gravity separation tanks. To remove the labels and adhesive from the housing pieces, a separation tank contains a detergent solution capable of assisting in dissolving the adhesive. The tank is provided with a group of heating elements to cause the detergent solution to boil in the immediate vicinity thereof. As housing pieces travel past the heating elements they are rolled around, swirled and submerged and each housing piece with a label portion adhered thereto is exposed to the boiling detergent solution. The adhesive is thus dissolved and the label portions are driven off the housing pieces.

U.S. Pat. No. 5,616,067 to Goenka, issued Apr. 1, 1997—In an apparatus for cleaning a workpiece with abrasive $CO_2$ particles, a $CO_2$ nozzle receives and expels liquid $CO_2$ through at least one orifice sized for at least partially converting the liquid into $CO_2$ particles. The $CO_2$ particles are injected into a converging-diverging nozzle at a location adjacent to the throat section thereof. Pressurized air is directed into the converging section of the nozzle upstream from the throat section. The pressurized air accelerates the $CO_2$ particles which are focused by the diverging section of the nozzle for impacting the pressure-sensitive surface of the workpiece to be cleaned.

U.S. Pat. No. 5,390,450 to Goenka, issued Feb. 21, 1995—A $CO_2$ nozzle receives and expels liquid $CO_2$ through orifices sized for converting the $CO_2$ liquid into $CO_2$ snow. A body, defining an elongated cavity therein, is coupled to the $CO_2$ nozzle such that the $CO_2$ snow is ejected into the cavity. An exhaust nozzle is coupled to the body and the cavity therein for directing the pressurized $CO_2$ snow toward the workpiece. The exhaust nozzle is operated in an overexpanded mode for containing the shockwave within the nozzle for reducing the shear noise therefrom. Pressurized air is injected into the elongated cavity for exhausting the $CO_2$ snow under pressure.

U.S. Pat. No. 5,679,062 to Goenka, issued Oct. 21, 1997—An apparatus and method for cleaning a workpiece with abrasive $CO_2$ snow operates with a nozzle for creating and expelling the snow. The nozzle includes an upstream section defined by a first contour for receiving $CO_2$ in a gaseous form. The nozzle also includes a downstream section for directing the flow of the $CO_2$ and the snow toward the workpiece, with the downstream section having a second contour optimized for supersonic flow of the $CO_2$. The nozzle includes a throat section, interposed between the upstream and downstream sections, for changing the $CO_2$ from the gaseous phase to an intermediate mixture of $CO_2$ gas, liquid and snow within the downstream section at a speed of at least Mach 1.1. A turbulence cavity section is interposed between the throat section and the downstream section for inducing both turbulence within the $CO_2$ gas flowing therethrough, thereby increasing the nucleation and agglomeration of the $CO_2$ within a snow zone defined within the downstream section. The throat, upstream, turbulence cavity and downstream sections of the nozzle may be manufactured from silicon micromachined surfaces.

U.S. Pat. No. 5,976,264 to McCullough et al, issued Nov. 2, 1999—A method for the removal of fluorine or chlorine residue from an etched precision surface such as a semiconductor sample is provided which comprises exposing said precision surface to liquid $CO_2$ under appropriate conditions that are sufficient to remove the residue from the precision surface. Cryogenic aerosol may be used in conjunction with liquid $CO_2$.

U.S. Pat. No. 5,836,809 to Kosic, issued Nov. 17, 1998—In accordance with the teachings of the present invention, an apparatus and method for cleaning large glass plates each having first and second major surfaces is provided. The apparatus (10) includes an enclosure (14) which maintains a cleaning environment in which a glass plate (42) is decontaminated. An actuated support member (40) vertically translates the glass plate (42) into the enclosure (14) where it is supported with its first (46) and second (48) major surfaces substantially perpendicular to a ground plane defined by the floor space (12) occupied by the apparatus (10). A pair of opposing arrays of jet spray nozzles (62 and 64) coupled to a pressurized supply of liquid carbon dioxide (94) is provided for simultaneously directing carbon dioxide snow particles (96) in directions of the first and second major surfaces (46 and 48) of the glass plate (42), thereby removing contamination therefrom. The carbon dioxide snow particles (96) sublime within the cleaning environment of the enclosure (14).

U.S. Pat. No. 5,108,512 to Goffnett et al. issued on Apr. 28, 1992—A process is disclosed for the cleaning of the inner surfaces of a chemical vapor deposition reactor used in the production of polycrystalline silicon. The process comprises impacting the surfaces to be cleaned with solid carbon dioxide pellets. The carbon dioxide pellets dislodge silicon deposits from the surface of the reactor without damaging the surface of the reactor and without providing a source for contamination of polycrystalline silicon produced in the cleaned reactor. The present process is particularly useful for the cleaning of the inner surfaces of chemical vapor deposition reactors used in the production of semi-conductor grade silicon.

U.S. Pat. No. 5,919,594 to Perry et al. issued Jul. 6, 1999—A photoreceptor fabrication method is disclosed composed of spraying a honing composition including particulate material against a substrate in a particulate material spray distribution containing only one peak in a graph of the number of particulate material versus distance along the spray area to create a predetermined surface roughness.

CROSS REFERENCE TO COPENDING APPLICATIONS

U.S. patent application Ser. No. 09/628,865, entitled "HOLLOW CYLINDRICAL IMAGING MEMBER TREATMENT PROCESS" filed concurrently herewith, in the names of R. Millonzi et al.—A process is disclosed for treating an electrostatographic imaging member including providing a hollow cylindrical electrostatographic imaging member having an interior surface, a coated outer surface, a first end and a second end, the interior surface at at least the first end having a coating of adhesive material securing a first end flange to the first end, and propelling solid carbon dioxide pellets against the first end flange and coating of adhesive material with sufficient force to remove the first end flange and coating of adhesive material from the interior surface at at least the first end of the hollow cylindrical electrostatographic imaging member.

U.S. patent application Ser. No. 09/628,258, entitled "PROCESS FOR REMOVING COATINGS" filed concurrently herewith, in the names of G. Arsenio et al.—A process is described comprising providing a hollow cylindrical substrate having an imaginary axis, an inner surface and an arcuate outer surface, the outer surface having at least one outer coating comprising a film forming polymer, propelling solid carbon dioxide irregular granules against the coating to remove the at least one outer coating.

U.S. patent application Ser. No. 09/371,766, entitled "AN APPARATUS AND METHOD FOR REMOVING A LABEL FROM A SURFACE WITH A CHILLED MEDIUM" filed on Aug. 10, 1999, in the names of Agarwala et al.—An apparatus for removing labels from a housing is provided. The apparatus includes a tank for storing a medium at a pressure above ambient pressure. The apparatus also includes a medium conduit in communication with the tank for transporting the medium therefrom. The conduit defines a opening therein. The medium exiting the conduit at the opening is adapted to remove labels from the housing.

The entire disclosures of each of the above cited patents and patent applications are incorporated herein by reference.

While the above mentioned treatment techniques may be suitable for their intended purposes, there continues to be a need for improved process for effectively, economically and precisely hone the outer surface of substrates.

BRIEF SUMMARY OF THE INVENTION

It is an object of this invention to form a substrate surface having a precise brightness range to enable use of automatic visual inspection (AVI) systems to detect brightness and set up machine parameters for density control of the final image.

It is another object of this invention to precisely hone the outer surface of inexpensive substrates.

It is yet another object of this invention to clean the outer surface of substrates.

It is still another object of this invention to precisely hone without machining the outer surface of substrates to form a diffuse surface.

It is a further object of this invention to provide a process which blasts solid particulate carbon dioxide particles against the outer surface of the substrate.

It is another object of this invention to provide a process employing honing material which sublimes without forming toxic fumes.

It is yet another object of this invention to provide a process which efficiently removes the presence of undesirable oil materials on the outer surface of a substrate.

It is still another object of this invention to provide a process which eliminates the need for aluminum oxide honing media.

It is a further object of this invention to provide a process which eliminates post coat defects that can be caused by aluminum oxide honing media.

It is another object of this invention to provide a process which leaves no residual deposits.

It is yet another object of this invention to provide a process which alters the texture of the surface of photoreceptor substrates.

It is still another object of this invention to provide a process which dissolves oils.

It is another object of this invention to provide a process which is cleaner.

It is another object of this invention to provide a process which removes residual films.

The foregoing objects and others are accomplished in accordance with this invention by providing a process comprising, providing a member having an exposed outer metal surface and propelling irregularly shaped solid carbon dioxide granules against the exposed outer metal surface with sufficient force to alter the texture of the outer metal surface.

Any suitable member may be treated with the process of this invention. The member may have any suitable shape including, for example, a plate, seamless belt, hollow or solid cylinder, and the like. Preferably, the substrate is a hollow cylinder having an imaginary axis, the exposed outer metal surface, a first end and a second end, the exposed outer surface being substantially free of any nonmetallic electrically insulating coating. The member may comprise any suitable metallic material. Typical materials include, for example, metals such as aluminum, aluminum alloys, stainless steel, brass, nickel, and the like. Generally the substrates are relatively soft and are preferably characterized with a yield strength of between about 10,000 pounds/in$^2$ (703 kilograms/cm$^2$) and about 20,000 pounds/in$^2$ (1,406 kilograms/cm$^2$). Uncoated substantially homogeneous aluminum or aluminum alloy substrates are preferred. Typical aluminum alloys include, for example, 1050, 1100, 3003, 6061, 6063, and the like. Alloy 3003 contains Al, 0.12 percent by weight Si, 0.43 percent by weight Fe, 0.14 percent by weight Cu, 1.04 percent by weight Mn, 0.01 percent by weight Mg, 0.01 percent by weight Zn, 0.01 percent by weight Ti, and a trace amount of Cr. The size and distribution of inclusions and intermetallic compounds in the alloy should be below the level at which the inclusions and intermetallic particles would pose a problem for the honing process and ultimately interfere with the subsequent electrophotographic properties of the final device. Nonuniform surface texture with patches of unhoned regions may result if many large inclusions or intermetallics are present. Similarly, the ductility properties of the aluminum substrate should be substantially uniform to ensure a uniform texture upon completion of the honing process. Generally, the surface of the substrate may be relatively smooth prior to honing. Typical smooth surfaces are formed by, e.g., diamond lathing, specialized extrusion and drawing processes, grinding, buffing and the like. Surface roughness can be characterized by the following parameters: $R_a$ (mean roughness), $R_t$ (maximum roughness depth), $R_{pm}$ (mean leveling depth), $W_t$(waviness depth), and $P_t$ (profile depth). After smoothing but prior to any honing, the substrate can have a typical surface roughness in the range for example of $R_a$ of about 0.05 micrometer and $R_{max}$ of about 0.5 micrometer to $R_a$ of about 0.2 micrometer and $R_{max}$ of about 2.0 micrometer. $R_a$ is the arithmetic average of all departures of the roughness profile from the center line within the evaluation length. $R_a$ is defined by a formula:

$$R_a = \frac{1}{l_m}\int_0^{l_m} |y|\,dx$$

in which $I_m$ represents the evaluation length, and $|y|$ represents the absolute value of departures of the roughness profile from the center line.

The expression $R_{max}$ represents the largest single roughness gap within the evaluation length. The evaluation length is that part of the traversing length that is evaluated. An evaluation length containing five consecutive sampling lengths is taken as a standard. These materials are described, for example, in U.S. Pat. No. 5,919,594, col. 4, lines 10–53, the entire disclosure thereof being incorporated herein by reference. Measurements of the various surface roughness parameters described herein may be made with a profilameter such as Perthen Model S3P or Model S8P manufactured by Mahr Feinpruef Corporation. Generally, a stylus with a diamond tip is traversed over the surface of the roughened substrate at a constant speed to obtain all data points within an evaluation length. The radius of curvature of the diamond tip used to obtain all data referred to herein is 2 micrometers.

Aluminum substrate members are preferred because they comprise a relatively soft material. Especially preferred are net drawn aluminum hollow metal cylinders or drums. The use of aluminum tubes net drawn to desired dimensional specifications eliminates the need for subsequent lathe machining to achieve required dimensions. The expression "net drawn", as employed herein, is defined as extruded aluminum tubes or drums.

The carbon dioxide particles are irregular in shape. These carbon dioxide particles or granules may be formed from grinding solid blocks of carbon dioxide (dry ice) or by phase transformation followed by fracturing. Pellets or shaved dry ice sources may also be used. Each style of $CO_2$ blasting involves a different process to form irregularly shaped $CO_2$ crystals. The grinding process involves shaving solid blocks of carbon dioxide (dry ice) to form irregularly shaped particles. The irregularly shaped carbon dioxide particles are fractured solid particles having random angular surface features comprising corners, sharp edges and the like, and therefore, are unlike cylindrically shaped carbon dioxide pellets, carbon dioxide snowflakes, or carbon dioxide spheres. The irregular shape promotes the formation of a diffuse surface which enables the use of automatic visual inspection (AVI) systems to detect brightness and set up machine parameters for density control of the final electrophotographic image. It is essential that the carbon dioxide particles or granules are clean. The carbon dioxide particles or granules preferably have an average particle size between about 50 micrometers and about 1000 micrometers. Further, the particulate material may have a bulk specific gravity ranging, for example, from about 1 gram/cm$^3$ to about 5 grams/cm$^3$. The bulk specific gravity of the particulate material is preferably about 1 gram/cm$^3$ to about 3 grams/cm$^3$ and more preferably about 1.2 gram/cm$^3$ to about 2 grams/cm$^3$.

A typical phase transformation process operates as follows: Liquid carbon dioxide is fed into a machine deemed a "pelletizer." Pelletizers are commercially available. A typical unit useful for testing is a Model 750 available from Cold Jet, Inc.

The pelletizer converts the liquid phase into the solid phase by extrusion, forming cylindrically-shaped carbon dioxide pellets. In a typical test, pellets extruded had a nominal diameter of 0.045 inch (1.143 millimeters) and lengths between ⅛ inch (3.175 millimeters) and ⅜ inch (9.525 millimeters). As the pellets are transported to the gun, they collide with each other and transport system conduit walls, thus randomly breaking them up into irregularly-shaped granules. The pelletizing (or extrusion) $CO_2$ pellet forming process implements different sized die so that the pellet size can be dialed in to the appropriate value. Since collisions occur during transport, pellets are always extruded larger than the granules exiting from the gun. Experimentation determines what size to extrude to obtain the proper granule size at gun exit to be between 50 micrometers and 1000 micrometers. In this way, both $CO_2$ pellet forming process yield the same size granules at the gun exit.

The substrate members are honed using a $CO_2$ blasting process which sufficiently roughens the outer surface of the member to achieve plywood suppression. The $CO_2$ blasting process utilizes a gun which fires the irregular $CO_2$ particles through a nozzle onto the outer surface of the substrate member. The nozzle shape can be of any conventional design useful for the acceleration and propulsion of carbon dioxide particles with sufficient speed to hone the substrate upon impact. Preferably, the nozzle shape produces conical or fan spray patterns. Typical nozzles are described in the U.S. Pat. No. 5,919,594, the entire disclosure thereof being incorporated herein by reference. An example of a nozzle is a "venturi" nozzle. A venturi nozzle comprises a short, narrow center section and widened, tapered ends. The ends and the center section in a venturi nozzle are curved slightly. Such a nozzle maximizes the velocity at which carbon dioxide particles are projected at the substrate. If desired, the nozzle 4 may be fitted with a conventional cooling jacket. Typical guns, which mix the carbon dioxide particles with a gas such as air, are commercially available, for example, from Cold Jet, Inc., CAE-Alpheus and the like. The carbon dioxide particles are fed from a grinder or pelletizer to the gun through any suitable conduit using low pressure gas referred to as transport gas. Preferably, the pressure for the transport gas is between about 5 p.s.i. (0.35 kg/cm$^2$) and about 45 p.s.i. (3.2 kg/cm$^2$). The transport gas transports the $CO_2$ pellets down the conduit to be mixed with high pressure blast gas inside the gun. The pressure of the transport gas pressure must be high enough to transport the $CO_2$ pellets without clogging in the conduit. The pressure for the transport gas is increased as the distance from the $CO_2$ pellet supply to the gun increases. Thus, where the pellet transport conduit is quite long, a pressure for the transport gas as high as 45 p.s.i. (3.2 kg/cm$^2$) may be necessary. However, a transport gas pressure greater than about 45 p.s.i. (3.2 kg/cm$^2$) is less desirable because it approaches the blast gas pressure range of between about 55 p.s.i. (3.9 kg/cm$^2$) and about 65 p.s.i. (4.6 kg/cm$^2$). The conduit may be cooled, if desired, to reduce sublimation of the carbon dioxide particles. Preferred nozzles are described in pending U.S. patent application Ser. No. 09/371,765, entitled "APPARATUS AND METHOD FOR CLEANING A SOFT SURFACE WITH A CHILLED MEDIUM", filed on Apr. 10, 1999 in the names of Agarwala et al. and pending U.S. patent application Ser. No. 09/371,765, entitled "APPARATUS AND METHOD FOR REMOVING A LABEL FROM A SURFACE WITH A CHILLED MEDIUM", filed on Apr. 10, 1999 in the names of Agarwala et al. The entire disclosures of these pending applications are incorporated herein by reference.

Inside of the gun, the particles transported using low pressure gas, are mixed with a high pressure gas, referred to as "blast gas." Preferably, the blast gas used to propel the carbon dioxide particles from the gun is dried prior to use of the propellant. Any suitable inert gas may be employed as blast gas to propel the carbon dioxide particles. Typical inert gases include, for example, air, nitrogen, carbon dioxide, argon, and the like. A typical blast gas pressure is air at about 60 p.s.i. (4.2 kilograms/cm$^2$). An external pressured source for blast gas to propel the carbon dioxide particles against the exposed outer surface of the member is preferably maintained at a pressure of between about 55 psi (3.9 kg/cm$^2$) and about 65 psi (4.6 kg/cm$^2$). The particle velocity should be sufficient to produce a predetermined surface roughness on the metal substrate member in order to achieve a uniformly diffuse surface. The irregularly shaped solid carbon dioxide granules are propelled as at least one stream against the exposed outer surface of the member. Multiple streams of propelled granules may be employed, if desired, for reducing cycle time. The steams may have any suitable cross section. Typical cross sections include, for example, round, oval, rectangular, conical, elliptical, and the like. The shape of the cross section of the stream may be controlled by the shape of the nozzle opening. The nozzle material should be resistant to erosion at the temperatures employed. Typical nozzle materials include, for example, stainless steel, nylon, rubber, polyurethane, polyethylene, and the like. The cycle time, particle size, particle velocity, blast pressure, relative speed of traverse, rotation speed of the substrate, and the like, vary depending upon the amount of roughness desired and the type of material used for the substrate.

Preferably, the honing conditions are selected to achieve a predetermined surface roughness defined by $R_a$ ranging from about 0.05 micrometer to about 0.5 micrometer, more preferably from about 0.1 micrometer to about 0.3 micrometer, and most preferably from about 0.17 micrometer to about 0.23 micrometer. $R_{max}$ is the vertical distance between the highest peak and the lowest valley of the roughness profile R within the evaluation length and preferably ranges from about 0.5 micrometer to about 4 micrometers, and more preferably less than about 3 micrometers. $R_k$ is the mean of five leveling depths of five successive sample lengths and preferably ranges from about 0.2 micrometer to about 2 micrometers, and more preferably from about 0.55 micrometer to about 0.75 micrometer. $W_t$ is the vertical distance between the highest and lowest points of the waviness profile W within the evaluation length and preferably ranges from about 0.1 micrometer to about 1 micrometer, and more preferably from about 0.15 micrometer to about 0.5 micrometer. $P_t$ is the distance between two parallel lines enveloping the profile within the evaluation length at their minimum separation and preferably ranges from about 0.8 micrometer to about 6 micrometers, and more preferably from about 1 micrometer to about 4 micrometers. Significant suppression of the interference fringe effect may be observed in embodiments of the present invention at the light source wavelengths conventionally used, including a light source having a wavelength at 780 nm. The gun may be moved over a stationary substrate, or a substrate may be moved under a stationary gun, or both the gun and the drum may be moved simultaneously to achieve relative motion. Preferably, the path of the propelled carbon dioxide particles is substantially perpendicular to an imaginary tangent on the surface of the drum. The expression "substantially perpendicular" as employed herein is defined as plus or minus 10° from perpendicular to an imaginary tangent on the surface of the drum. Low path angles relative to the an imaginary tangent on the surface of the drum, tend to produce undesirable striations and non-uniformities. It is also preferred that the gun is translated in a linear direction parallel to the axis of the drum while the drum is rotated about its axis on any suitable device such as a lathe, parallel rotating rollers, and the like. Thus, typically, at least one stream of irregularly shaped solid carbon dioxide granules is moved linearly along the length of a rotating cylinder in a direction parallel to the imaginary axis. The distance between the gun nozzle and the substrate to be treated is between about 100 mm and about 300 mm. The cylindrical substrate is rotated about its axis at a surface speed of between about 40 cm/sec (where the substrate is for example an 84 mm diameter drum) and about 60 cm/sec (where the substrate is for example a 30 mm diameter drum), or about 100 to about 400 rpm.

If desired, a vacuum system may be employed to collect material removed from the substrate by the carbon dioxide particles.

Since the carbon dioxide particles appear to dissolve residual oil contaminates on the outer surface of the substrate member, cleaning of the substrate prior to and following $CO_2$ honing may be omitted, if desired. Moreover, the irregular solid $CO_2$ granules quickly sublime after impact and do not remain on the honed surface as a potential coating defect as does the conventional alumina media.

In fabricating a photosensitive imaging member, a charge generating material (CGM) and a charge transport material (CTM) may be deposited onto the substrate surface either in a laminate type configuration where the CGM and CTM are in different layers or in a single layer configuration where the CGM and CTM are in the same layer along with a binder resin. When applied as different layers, the CTM in a charge transport layer may be applied to the substrate surface prior to or subsequent to application of the CGM in a charge generating layer. Typical organic photoconductive charge generating materials include, for example, azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, titanyl phthalocyanine, hydroxy gallium phthalocyanine and the like; quinacridone pigments; or azulene compounds. Typical inorganic photoconductive charge generating materials include, for example, cadmium sulfide, cadmium sulfoselenide, cadmium selenide, crystalline and selenium, lead oxide and other chalcogenides.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

Any suitable charge transport material may be used. Typical charge transport materials include, for example, organic polymer or non-polymeric material capable of supporting the injection of photoexcited holes or transporting electrons from the photoconductive material and allowing the transport of these holes or electrons through the organic layer to selectively dissipate a surface charge. Typical charge transport materials include, for example, a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, hydrazone compounds, and the like. Other typical transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly (vinyltetracene), poly(vinylperylene) , and the like. Typical electron transport materials include, for example, electron acceptors such as 2,4,7-trinitro-9-fluorenone; 2,4,5,7-tetranitro-fluorenone; dinitroanthracene; dinitroacridene; tetracyanopyrene, dinitroanthraquinone, and the like.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Weight average molecular weights can vary, for example, from about 20,000 to about 1,500,000.

Any suitable technique may be utilized to apply the charge generating material (CGM) and a charge transport material (CTM) onto the substrate surface either in a laminate type configuration or in a single layer configuration. Charge transport layer and the charge generating layer after altering the texture of the outer surface to the predetermined surface roughness. Typical application techniques include spraying, dip coating, roll coating, wire wound rod coating, and the like. Dip coating is a preferred coating technique where the dipping and raising motions of the substrate relative to the coating solution may be accomplished at any suitable speed. Drying of the deposited coating may be effected by any suitable conventional technique such as oven drying, infra-red radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to 200:1 and in some instances as great as 400:1.

If desired, an optional charge blocking layer may be applied to the substrate surface after alteration of the texture of the outer surface to the predetermined surface roughness and prior to application of the charge generating layer or charge transport layer. Any suitable blocking layer material may be employed. Charge blocking layers are well known in the art. The blocking layer may be organic or inorganic and may be deposited by any suitable technique. Typical blocking layers include polyvinylbutyral, organosilanes, epoxy resins, polyesters, polyamides, polyurethanes, pyroxyline vinylidene chloride resin, silicone resins, fluorocarbon resins and the like. Other blocking layer materials include nitrogen-containing siloxanes or nitrogen- containing titanium compounds such as trimethoxysilyl propylene diamine, hydrolyzed trimethoxysilylpropylethylene diamine, N- beta-(aminoethyl)-gamma-aminopropyltrimethoxy silane, isopropyl- 4-aminobenzene sulfonyl, di(dodecylbenzene sulfonyl) titanate, isopropyl-di (4-aminobenzoyl)isostearoyl titanate, isopropyl- tri(N-ethylamino-ethylamino) titanate, isopropyl trianthranil titanate, isopropyl-tri-(N,N-dimethylethylamino) titanate, titanium-4-amino benzene sulfonatoxyacetate, titanium 4-aminobenzoate-isostearate-oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyldiethoxy silane, and the like. The blocking layer should be continuous and usually has an average thickness of less than about 5000 Angstrom units.

The photosensitive imaging member produced according to the invention can be tested for print quality assessment in a Xerox Document Centre 230 (a multifunction laser printing machine) at an initial charging voltage of about 480 volts. The Document Center 230 has a 780 nm wavelength laser diode as the exposure source and a single component discharged area development (DAD) system with 7 micrometer toner. Interference fringe effect is tested in a gray scale print mode using specified halftone patterns. The interference fringes, or plywood fringes, are not observed, and no degradation of print quality is observed due to black spots. Similar results may be achieved with other laser-based machines, e.g., those with an exposure light source that operates in the range of 600–800 nm.

Use of the $CO_2$ honing process of this invention provides a sufficiently diffuse surface to enable plywood suppression. Use of preferred substrate members that are net drawn tubes eliminates the expense of machining and also reduces substrate cost. Quality of the final imaging member is improved by eliminating the need for aluminum oxide media which often contribute to post coat defects. Since the roughening process of this invention uses solid $CO_2$ pellets which quickly sublime, the process eliminates potential coating defects as does alumina media. Additionally, the $CO_2$ blasting process of this invention simultaneously performs a cleaning function because the irregular $CO_2$ particles dissolve residual oils while the force of impingement sweeps the dissolved oils away.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A 6063 alloy net drawn aluminum hollow cylindrical substrate, 84 mm diameter and 340 mm long, with a surface roughness, $R_a$, of 0.05 micrometer was honed prior to application of photoconductive coatings. Honing was accomplished by using a gun which mixed carbon dioxide particles with air to fire the $CO_2$ particles through a nozzle onto the outer surface of the substrate while the substrate was rotated on a lathe at 400 rpm. The gun is described in U.S. patent application Ser. No. 09/371,766, entitled "AN APPARATUS AND METHOD FOR REMOVING A LABEL FROM A SURFACE WITH A CHILLED MEDIUM" filed on Aug. 10, 1999, in the names of Agarwala et al. The entire disclosure of this application is incorporated herein by reference. The nozzle exit of the gun had a round, but varying, cross section. The nozzle was 8 inches (20 cm) long and constantly tapered from 13 mm at the input end to 15 mm on the output end. The gun operated using transport air at 45 p.s.i. (3.2 kg/cm$^2$) and blast air at 60 p.s.i (4.2 kg/cm$^2$). The carbon dioxide particles were formed by a pelletizer that yielded cylindrically shaped pellets of about 0.045Δ in diameter and ¼" in length. The pellets became further augmented in random fashion to form fractured, irregularly shaped granules as they were transported to the gun in the transport air conduit. The air used to propel the carbon dioxide particles was dried prior to use as a propellant. The gun traversed the substrate from one end to the other along a straight path parallel to the axis of the substrate. The rate of gun traverse was 400 millimeters per minute. The path of the propelled carbon dioxide particles was substantially perpendicular to an imaginary tangent on the outer surface of the hollow cylindrical substrate. The distance between the gun nozzle and the outer surface of the hollow cylindrical substrate was 265 millimeters. The path was traversed twice; once from the starting point to the ending point and then back to the starting point. The resulting honed substrate had a diffuse sheen on the outer surface and a surface roughness, $R_a$, of 0.2+/−0.05 micrometer. This honed was then coated with photoconductor layers. The first layer, an undercoat layer (UCL) used as an electrical blocking and adhesive layer, was applied, as all coatings were, by dip coating technology. A "three-component" UCL containing polyvinylbutyral (6 weight percent), zirconium acetyl acetonate (83 weight percent) and gamma-aminopropyl triethoxy silane (11 weight percent) were mixed, in the order listed, with n-butyl alcohol in a 60:40 (by volume) solvent to solute weight ratio was used for the UCL. The UCL was applied in a thickness of approximately one micrometer to the honed substrate by dip coating. The substrate was next coated with an about 0.2 micrometer thick charge generating layer (CGL) of hydroxygallium phthalocyanine (OHGaPc) and a terpolymer (VMCH, available from Union Carbide) of: vinyl chloride (83 weight percent), vinyl acetate (16 weight percent) and maleic anhydride (1 weight percent), dissolved in n-butyl acetate (4.5 weight percent solids) in a 60:40 weight ratio (60 OHGaPc:40 VMCH). The CGL was coated with a 24 micrometer thick (after dying) charge transport layer (CTL) of polycarbonate, derived from bis phenyl Z (PCZ400, available from Mitsubishi Chemical) and N,N'-diphenyl-N,N'-bis(3-methylphenyl)-(1,1'-biphenyl)-4,4'diamine dissolved in tetrahydrofuran. After coating and drying, the resulting photoreceptor was copy quality tested in a Xerox Document Centre 230 machine. The prints were of satisfactory quality and were free of the "plywood effect."

COMPARATIVE EXAMPLE II

A photoreceptor was fabricated and tested using the same procedures as described in Example I except that the net drawn substrate was not subjected to the honing treatment. The prints consistently showed the "plywood effect."

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process comprising providing a member having an exposed outer metal surface, propelling irregularly shaped solid carbon dioxide granules against the exposed outer metal surface with sufficient force to alter the texture of the outer metal surface to a predetermined surface roughness;

depositing a material selected from the group consisting of a charge generating material and a charge transport material after altering the texture of the outer surface to the predetermined surface roughness;

depositing onto the surface an optional blocking layer prior to depositing a material selected from the group consisting of a charge generating material and a charge transport material; and wherein the predetermined surface roughness is defined by $R_a$ ranging from about 0.05 micrometer to about 0.5 micrometer, $R_{max}$ ranging from about 0.5 micrometer to about 4 micrometers, $R_k$ ranging from about 0.2 micrometer to about 2 micrometers, $W_t$ ranging from about 0.1 micrometer to about 1 micrometer, and $P_t$ ranging from about 0.8 micrometer to about 6 micrometers.

2. A process according to claim 1 wherein the member having an exposed outer surface is a hollow metal cylinder having an imaginary axis, the exposed outer surface, a first end and a second end, the exposed outer surface being substantially free of any nonmetallic coating.

3. A process according to claim 2 wherein the hollow metal cylinder comprises a metal selected from the group consisting of aluminum and aluminum alloys.

4. A process according to claim 3 wherein the hollow metal cylinder comprises drawn aluminum.

5. A process according to claim 1 including forming the irregularly shaped solid carbon dioxide granules from a solid block of carbon dioxide.

6. A process according to claim 2 including rotating the cylinder around the imaginary axis while propelling the irregularly shaped solid carbon dioxide granules against the exposed outer surface.

7. A process according to claim 6 wherein the irregularly shaped solid carbon dioxide granules are propelled as at least one stream against the exposed outer surface.

8. A process according to claim 7 wherein the at least one stream of irregularly shaped solid carbon dioxide granules is moved linearly along the length of the rotating cylinder in a direction parallel to the imaginary axis.

9. A process according to claim 7 wherein the at least one stream of irregularly shaped solid carbon dioxide granules is substantially perpendicular to an imaginary tangent to the exposed outer surface of the substrate.

10. A process according to claim 1 wherein the irregularly shaped solid carbon dioxide granules have an average particle size between about 50 micrometers and about 1000 micrometers.

11. A process according to claim 1 wherein the irregularly shaped solid carbon dioxide granules have a bulk specific gravity between about 1 gram/$cm^3$ to about 5 grams/$cm^3$.

12. A process according to claim 11 wherein the irregularly shaped solid carbon dioxide granules are propelled using an air pressure of between about 3.9 kg/$cm^2$ and about 4.6 kg/$cm_2$.

13. A process according to claim 1 wherein the irregularly shaped solid carbon dioxide granules have a bulk specific gravity between about 1 gram/$cm^3$ to about 3 grams/$cm_3$.

14. A process according to claim 1 wherein the irregularly shaped solid carbon dioxide granules have a bulk specific gravity between about 1.2 gram/$cm^3$ to about 2 grams/$cm^3$.

* * * * *